United States Patent [19]

Kawai

[11] Patent Number: 4,730,981

[45] Date of Patent: Mar. 15, 1988

[54] CEILING FAN

[75] Inventor: Yuzo Kawai, Nara, Japan

[73] Assignee: Kabushiki Kaisha Suiden, Osakashi, Japan

[21] Appl. No.: 886,338

[22] Filed: Jul. 17, 1986

[30] Foreign Application Priority Data

Aug. 3, 1985 [JP] Japan ..... 60-171658

[51] Int. Cl.[4] ..... F04D 29/36

[52] U.S. Cl. ..... 416/83; 416/5; 416/170 R

[58] Field of Search ..... 416/83, 170 C, 5

[56] References Cited

U.S. PATENT DOCUMENTS

| | | | |
|---|---|---|---|
| 332,820 | 12/1885 | Murray | 416/83 X |
| 1,150,313 | 8/1915 | Stauffer et al. | 416/170 C |
| 1,227,291 | 5/1917 | Miller | 416/5 X |
| 1,362,036 | 12/1920 | Parker | 416/170 C |
| 1,409,090 | 3/1922 | Glasser | 416/83 |
| 1,577,461 | 3/1926 | Glasser | 416/83 |
| 1,864,316 | 6/1932 | Poniatowski | 416/83 |
| 2,674,407 | 4/1954 | Ostrognai | 416/5 X |
| 3,167,130 | 1/1965 | Day | 416/83 |
| 4,560,321 | 12/1985 | Kawai | 416/170 C |
| 4,640,668 | 2/1987 | Yang | 416/5 X |

FOREIGN PATENT DOCUMENTS

| | | |
|---|---|---|
| 58-74246 | 11/1984 | Japan . |
| 58-179837 | 4/1985 | Japan . |

*Primary Examiner*—Everette A. Powell, Jr.

*Attorney, Agent, or Firm*—Barnes & Thornburg

[57] ABSTRACT

A ceiling fan adapted for use in factories and office buildings, the ceiling fan including flapping vanes capable of vertically flapping during rotation, the double movement of the vanes being effective to stir and circulate the air in the room in a wide range. To effect the flapping of the vanes no wire or elevating members are used unlike the prior ceiling fan having flapping vanes.

4 Claims, 11 Drawing Figures

CEILING FAN

BACKGROUND OF THE INVENTION

1. Field of the Invention

The present invention relates to a ceiling fan adapted for use in factories and office buildings, the ceiling fan having flapping vanes.

2. Description of the Prior Art

There have been a variety of ceiling fans in use for industrial purposes at factories and office buildings. Typical examples are disclosed in Japanese Patent Applications Nos. 58-74246 and 58-179837. Each of the prior ceiling fans includes an elevating member slidably fitted around the motor shaft, stationary vanes fixed to the lower end of the motor shaft, flapping vanes pivotally connected to free ends of the respective stationary vanes, and wires each linking the free ends of the flapping vanes to the elevating member. The elevating member pulls up the free ends of the flapping vanes by means of the wires. This is repeated during the up and down movement of the elevating member, thereby enabling the vanes to flap continuously.

Under the known structure mentioned above the motor shaft must be long enough to allow the elevating member to move up and down over a required distance, and also to give space for providing the wires between the flapping vanes and the elevating member. This results in a large ceiling fan. A large ceiling fan is difficult to be installed in a limited space under the ceiling.

OBJECTS AND SUMMARY OF THE INVENTION

The present invention aims at solving the problems pointed out with respect to the prior ceiling fans, and has for its object to provide an improved ceiling fan of a small and compact size.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description and drawings.

According to the present invention, there is provided a ceiling fan having flapping vanes, the ceiling fan comprising:

- a motor casing accommodating a motor;
- a worm shaft having first threads fixed to the motor casing;
- a motor shaft rotatively passed through the worm shaft;
- a gear box having a boss through which the driving shaft is passed;
- a driver gear provided in the gear box, the gear being connected to the driving shaft through a bevel gearing;
- a follower gear train including a plurality of follower spur gear engageable with the driver gear;
- a number of crank rods corresponding to the number of flapping vanes, the crank rods being pivotally connected to the correspondingly selected number of follower gears; and
- flapping vanes rotatively connected to the crank rods so that the vanes flap in accordance with the reciprocal movement of the crank rods.

DETAILED DESCRIPTION OF THE PREFERRED EMBODIMENTS

Figure 1:
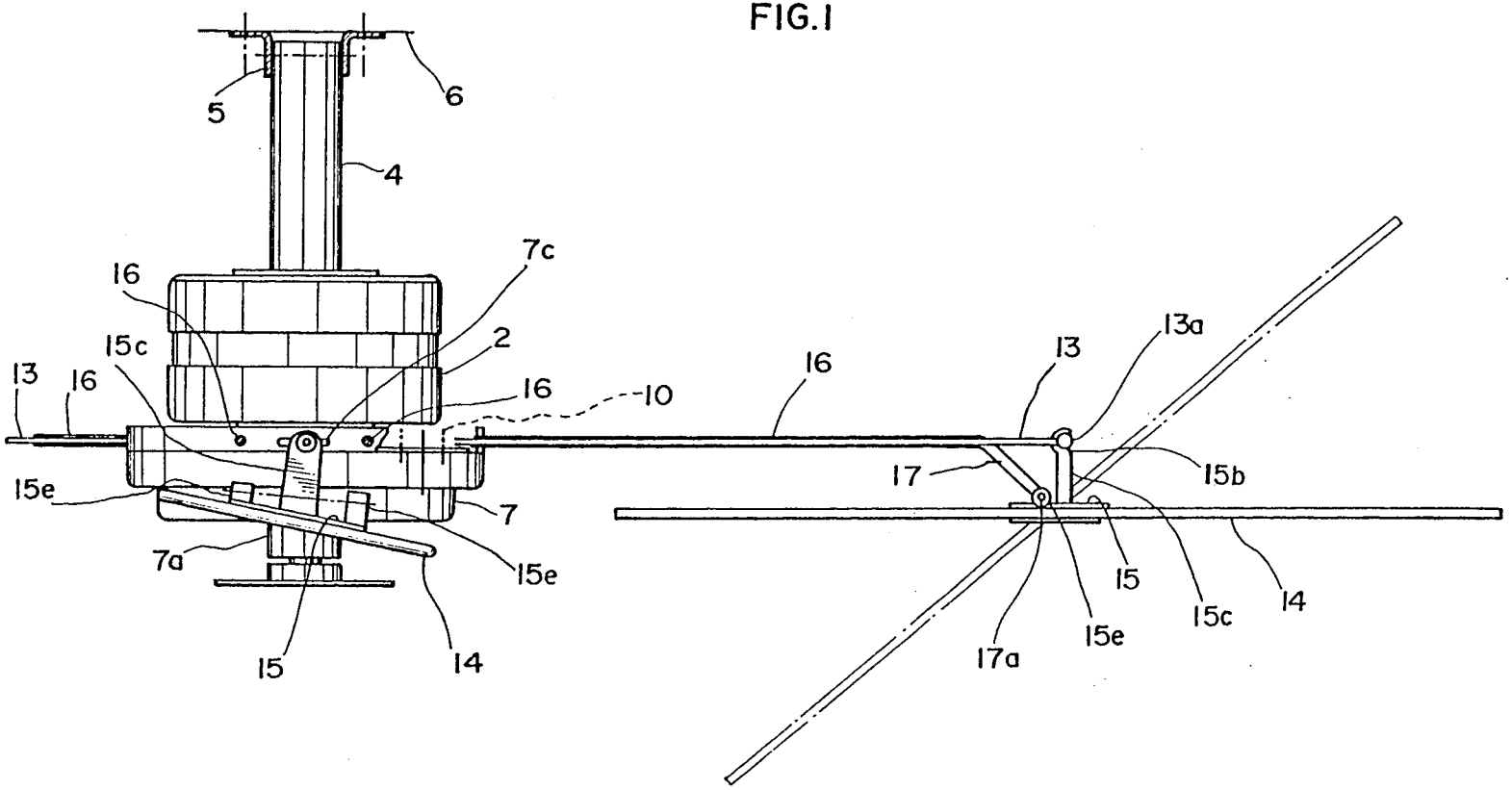
FIG. 1 is a partially broken front view of a preferred embodiment of the present invention.
Figure 2:
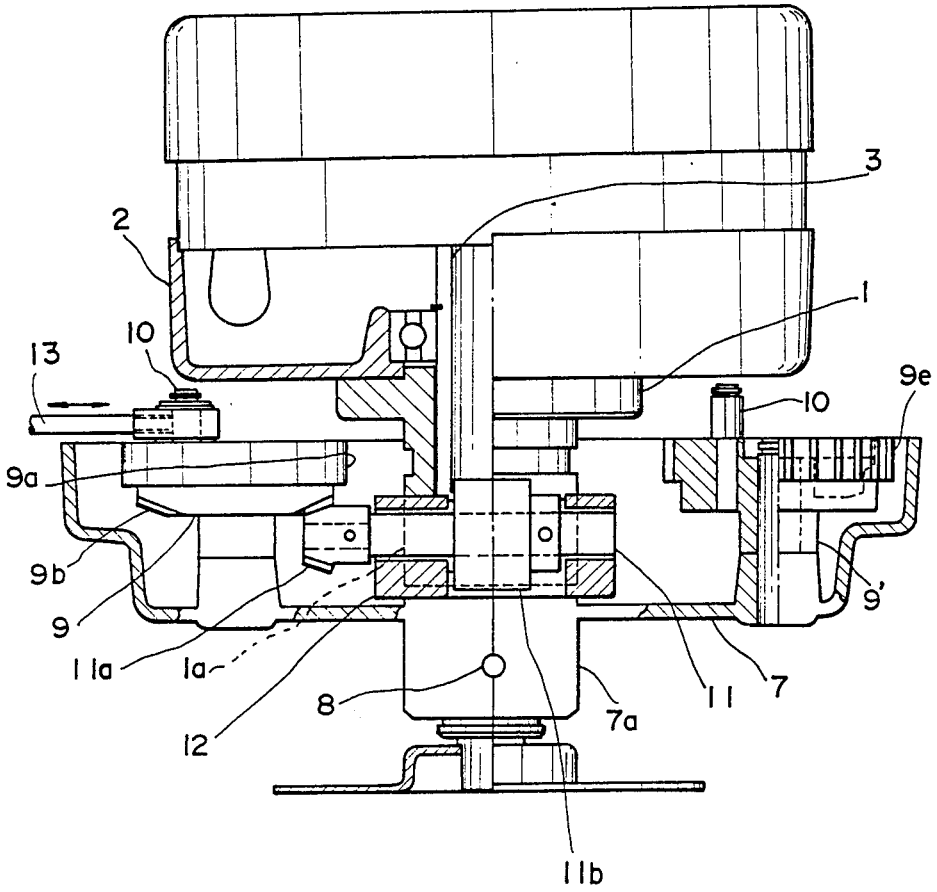
FIG. 2 is a partially sectional front view.
Figure 3:
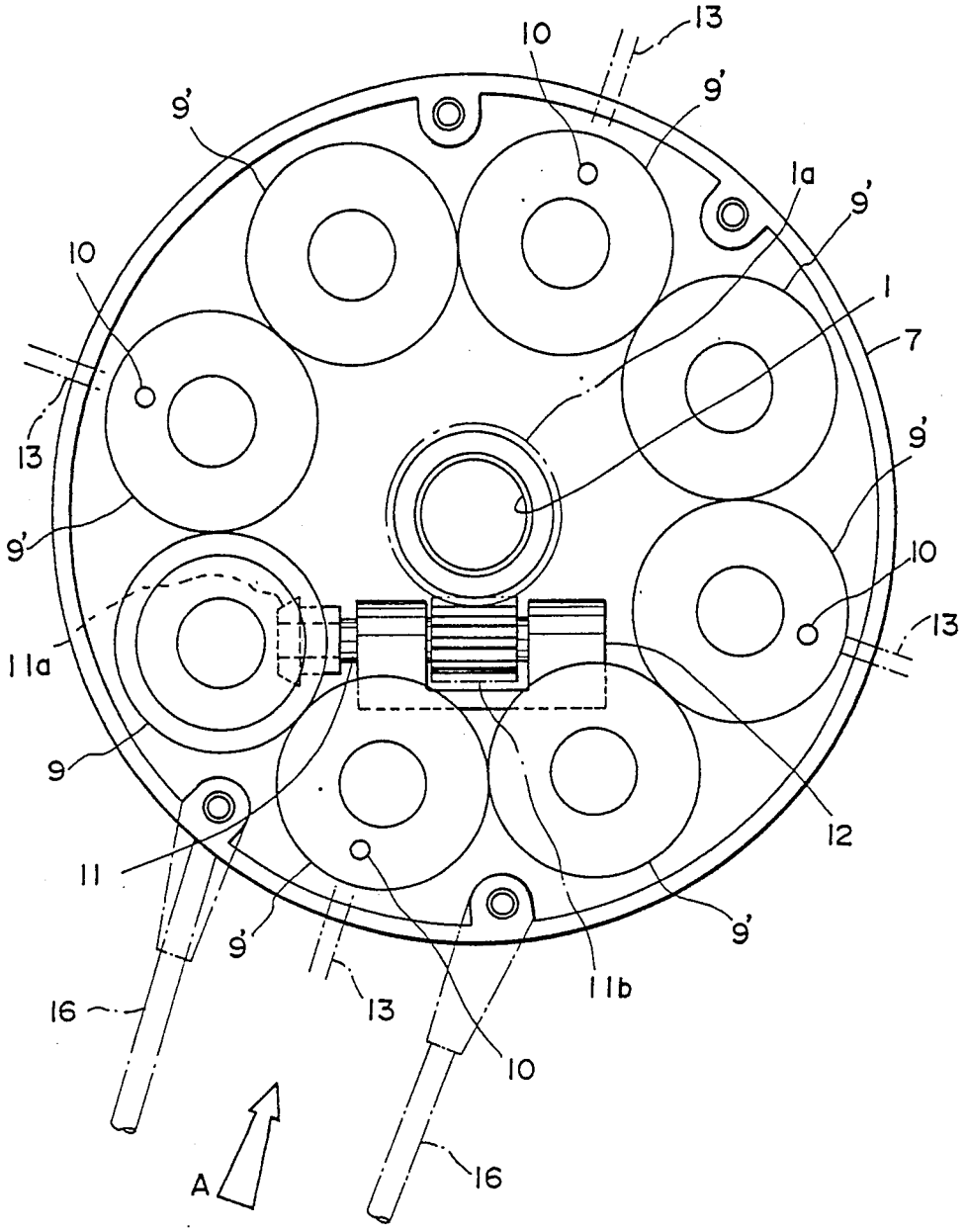
FIG. 3 is a partially broken plan view showing a gear train used in the embodiment of FIG. 1.
Figure 4:
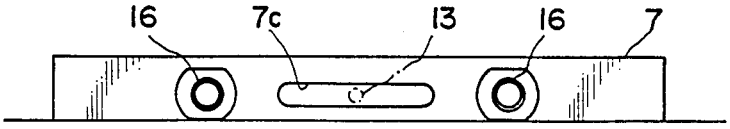
FIG. 4 is a side view viewed in the direction of arrow in FIG. 3.
Figure 5:
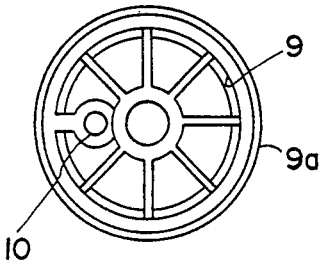
FIG. 5 is a diagrammatic plan view showing a spur gear.
Figure 6:
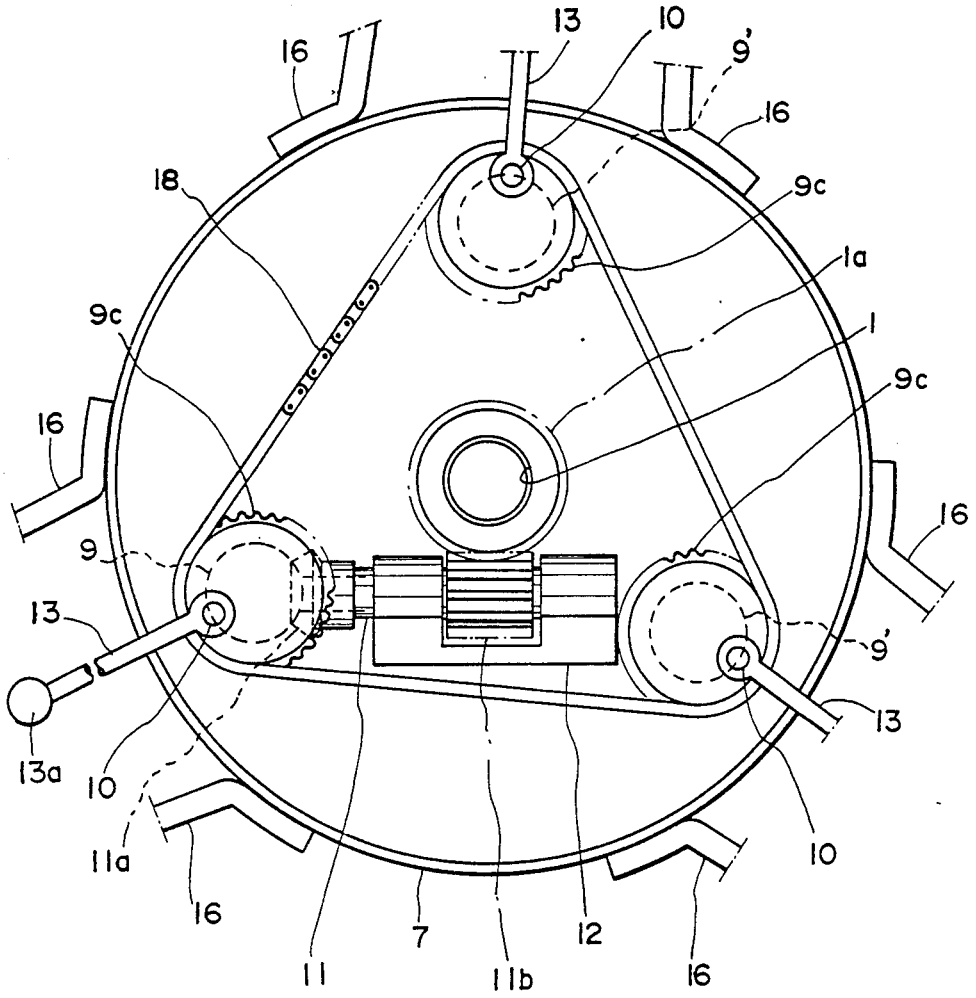
FIG. 6 is a partially broken plan view of another preferred embodiment, particularly showing the gear train used therein.

As seen in FIGS. 1 to 3, a flanged, hollow worm shaft 1 has a worm gear 1*a* formed around the outer periphery of a lower part thereof, and is fixed under a motor casing 2. A driving shaft 3 of the motor is passed through the hollow worm shaft 1. The motor casing 2 is suspended from a ceiling 6 by means of a hanger rod 4 erected on the top of the motor casing 2. The reference numeral 5 denotes a joint. There is provided a gear box 7 having a boss 7*a* at its center, through which the lower end of the driving shaft 3 is passed. The lower end of the driving shaft 3 is secured in the gear box 7 by the use of set screws 8, thereby allowing their unitary motion. Spur gears 9 and 9' are provided along the inner periphery of the gear box 7, wherein their teeth 9*a* and 9*e* are mutually engaged, whereby the gears 9 and 9' are rotated one after another. One of the gears 9, 9' is provided with a bevel gear teeth 9*b*. In addition, each other gear 9 or 9' is provided with a crank pin 10 eccentrically fixed thereto. The reference numeral 11 denotes a horizontal shaft carried by a bearing 12, which has a bevel gear 11*a* at one end, and a worm gear 11*b* in its middle portion. The bearing 12 is fixed at a central portion of the gear box 7. The bevel gear 11*a* engages the teeth 9*b* of the gear 9, and the worm gear 11*b* engages a worm gear 1*a* of the worm shaft 1. When the worm shaft 1 is rotated, all the gears 9, 9' are rotated through the worm gearing. Each crank pin 10 is pivotally connected to a connecting rod 13 which is passed through a hole 7*c* produced in a side wall of the gear box 7, wherein the connecting rods 13 extend in radial directions. As shown in FIG. 6, each connecting rod 13 has a ball at its top end.

Referring to FIGS. 1, 9 to 11, a vane 14 is provided with a seat member 15 at its center, which is shaped in an isosceles triangle with two legs 15*a*. Each leg 15*a* has a bracket 15*c* having a recess 15*b* adapted to accept the ball 13*a*. The seat member 15 is additionally provided with holes 15*d* in which the vane 14 is fixed at its central portion. A pair of bearing 15*e* are provided on the legs 15*a*. Two arms 16 are provided adjacent to each connecting rod 13. As best shown in FIG. 3, the arms 16 are located with the connecting rod 13 interlocated therebetween. The arm 16 is fixed to the gear box at its one end, and is bent downward and connected to a joint member 17, which has a pair of pins 17*a* extending in opposite directions. Each pin 17*a* is supported in a bearing 15*e* so as to be rotative. In this way the vane 14 is made capable of flapping.

In accordance with the movement of the crank pins 10 the connecting rods 13 are caused to reciprocate, thereby pulling the seat member 15 toward the gear box 7 through the balls 13*a*, and allowing the vanes 14 to return their horizontal postures by gravity. In this way the vanes 14 flap.

Figure 7:
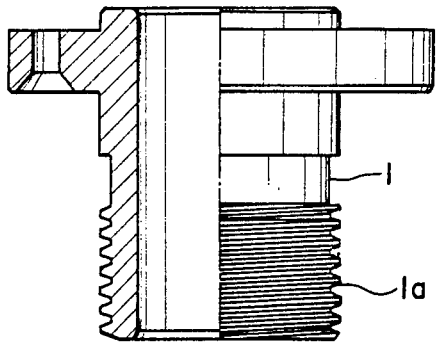
FIG. 7 is a partially sectional front view of a worm shaft.
Figure 8:
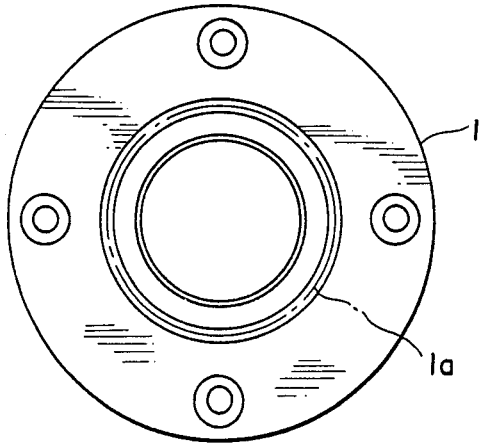
FIG. 8 is a plan view of the worm shaft.
Figure 9:
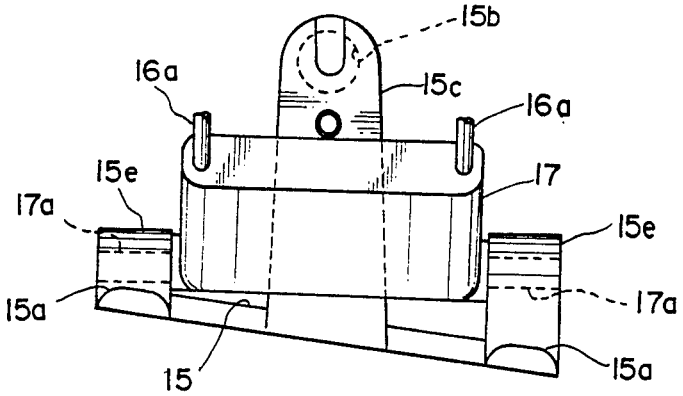
FIG. 9 is a partially sectional front view of the joint structure of a seat member and an arm.
Figure 10:
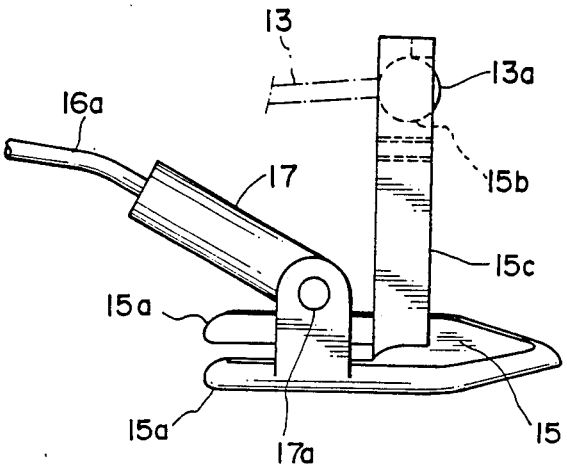
FIG. 10 is a left side view of the joint structure.
Figure 11:
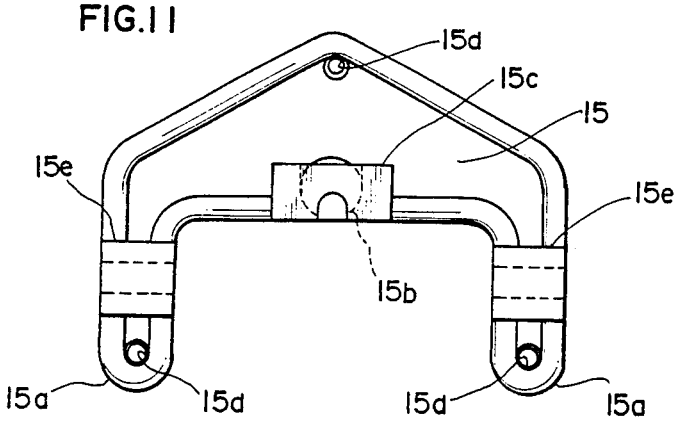
FIG. 11 is a plan view of a seat member.

Referring to FIGS. 6 to 8 another example of the embodiment will be described:

The reference numeral 9*c* denotes sprockets fixed to three gears 9 and 9' located in the form of a triangle, the three gears being connected by means of a single chain 18 running on the sprockets 9*c*. One of the gears is provided with a bevel gear which engages the bevel gear 11*a* of the horizontal shaft 11 in the same manner as shown in FIG. 3. The description of the worm gear 11*b*, the worm shaft 1 and the worm gear 1*a* will be omitted for simplicity.

As evident from the foregoing description, the ceiling fan of the present invention uses no wire or elevating members unlike the prior ceiling fan, thereby shortening the motor shaft and needing no space for the wires. This leads to the ceiling fan of a compact size and simplified structure. A compact size of ceiling fan is convenient in that it can be installed under a low ceiling or a limited space. The ceiling fan can be used for a long time, because no wire is used.

As a ceiling fan its flapping vanes are effective to stir the air in the room in a wide range, thereby effecting a good circulation of air throughout the room.

What is claimed is:

1. A ceiling fan having flapping vanes, the ceiling fan comprising:

a motor casing accommodating a motor;

a worm shaft fixed to the motor casing;

a motor shaft means rotatively passed through the worm shaft to drive said worm shaft and to also rotatingly drive the fan;

a gear box having a boss through which the driving shaft is passed;

a driver gear provided in the gear box, the gear being connected to the driving shaft through a bevel gearing on the worm shaft;

a follower gear train including a plurality of follower spur gear means engageable with the driver gear;

a number of crank rod means corresponding to the number of flapping vanes, the crank rod means being pivotally connected to the correspondingly selected number of follower gear means for reciprocating movement in a substantially horizontal plane; and flapping vanes rotatively connected to the crank rods so that the vanes flap in accordance with the substantially horizontal reciprocal movement of the crank rods.

2. A ceiling fan as defined in claim 1, wherein the crank rod means are eccentrically fixed to the respective gears through crank pins to provide the substantially horizontal reciprocal movement.

3. A ceiling fan as defined in claim 1, wherein the spur gears means rotate about an axis parallel to the rotation axis of the motor shaft.

4. A ceiling fan as defined in claim 2, wherein the spur gears means rotate about an axis parallel to the rotation axis of the motor shaft.

* * * * *